US005326930A

United States Patent [19]

Hayakawa

[11] Patent Number: 5,326,930

[45] Date of Patent: Jul. 5, 1994

[54] MUSICAL PLAYING DATA PROCESSOR

[75] Inventor: Tokuji Hayakawa, Hamamatsu, Japan

[73] Assignee: Yamaha Corporation, Hamamatsu, Japan

[21] Appl. No.: 20,859

[22] Filed: Feb. 19, 1993

Related U.S. Application Data

[63] Continuation of Ser. No. 595,025, Oct. 10, 1990, abandoned.

[30] Foreign Application Priority Data

Oct. 11, 1989 [JP] Japan ..... 1-264503
Oct. 11, 1989 [JP] Japan ..... 1-264504
Oct. 11, 1989 [JP] Japan ..... 1-264505

[51] Int. Cl.[5] ..... G10H 7/00
[52] U.S. Cl. ..... 84/636; 84/612
[58] Field of Search ..... 84/611, 612, 622, 633, 84/636, 671, 678, 714, DIG. 29, 470 R, 642, 668, 635

[56] References Cited

U.S. PATENT DOCUMENTS 3,955,466 5/1976 Goldmark ..... 84/470 R
4,454,797 6/1984 Amano .
4,614,983 9/1986 Usami ..... 84/DIG. 29
4,694,724 9/1987 Kikumoto et al. ..... 84/DIG. 29
4,847,710 7/1989 Morioka et al. ..... 84/642
4,899,632 2/1990 Okamura ..... 84/622
4,930,390 6/1990 Kellogg et al. ..... 84/611
4,969,384 11/1990 Kawasaki et al. ..... 84/636
4,993,306 2/1991 Ueta et al. ..... 84/635
5,092,216 3/1992 Wadhams ..... 84/642

FOREIGN PATENT DOCUMENTS 63-193194 8/1988 Japan .

OTHER PUBLICATIONS

Yamaha Publication entitled "Digital Sequence Recorder".

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

A playing musical data processor is provided with a specified punch-in/punch-out timing storage device and punch-in record device. During the period between the punch-in timing and the punch-out timing, the previously recorded musical playing data in that period is replaced with the musical playing data of the music played in real time. Also, the same recording operation can be done again as many times as desired. Also, the playing musical data processor is provided with a specified phrase timing storage device for storing timing data by clock number so as to more easily specify timing in music. During the period between the specified phrase timing and next phrase timing, the playing musical data in that period is reproduced repeatedly even if the phrase timings coincide with the timing of a bar end. Also the playing musical data processor is provided with a tempo data record device for recording tempo data in the midst of a musical time as a rate of change from an initial tempo value of the music.

15 Claims, 22 Drawing Sheets

Fig. 3(A)
Key on

| | |
|---|---|
| 90 H | |
| 0 | key code |
| 0 | touch |

Fig. 3(B)
Key off

| | |
|---|---|
| 80 H | |
| 0 | key code |
| 0 | touch |

Fig. 3(C)
Duration

| | |
|---|---|
| 0 | the number of clocks |

Fig. 3(D)
Long duration

| | |
|---|---|
| EOH | |
| 0 | the number of clocks |
| 0 | |

Fig. 3(E)
Tempo-up

| | |
|---|---|
| DOH | |
| 0 | rate of increment (%) |

Fig. 3(F)
Tempo-down

| | |
|---|---|
| COH | |
| 0 | rate of decrement (%) |

Fig. 3(G)
End code

| |
|---|
| FFH |

Fig.4

| | |
|---|---|
| SONG | PNTPI( i ) |
| RUN | PNTPO( i ) |
| PSE | TMPI( i ) |
| STP | TMPO( i ) |
| FR | EVCLK( i ) |
| T MP | REC( i ) |
| ITMP | PLY( i ) |
| DTMP | PRSBUF( n ) |
| PRS | STPNT( n, i ) |
| PNC | STCLK( n, i ) |
| GCLK | PRSST |
| PICLK | PRSEND |
| POCLK | |

MUSICAL PLAYING DATA PROCESSOR

This is a continuation of application Ser. No. 07/595,025, filed Oct. 10, 1990, now abandoned.

BACKGROUND OF THE INVENTION 1. (Field of the Invention)

The present invention relates to a musical playing data processor for recording and reproducing musical playing data for electronic musical instruments or the like, and more particularly to improvements of punch in recording functions.

2. (Description of the Prior Art)

A sequencer, which is a form of musical playing data recording and reproducing apparatus, is currently in practical use. The sequencer is capable of recording musical playing data in real time as it is actually played on an electronic musical instrument or the like and also reproducing recorded musical playing data on an electronic musical instrument or the like. In actually played music, errors and/or portions that the player finds unsatisfactory could occur, requiring corrections of such errors and/or portions. In such a case, rerecording the whole music over again not only takes a lot of time and effort of playing but might cause errors in other portions. In view of such difficulty, there has also been proposed a sequencer having a so-called punch-in recording function which replaces newly inputted musical playing data with previously recorded musical playing data in a specific period whereby only portions containing errors or found unsatisfactory in already recorded music can be replaced with new musical playing data.

However, the prior art sequencer has had the shortcoming that since the specified punch-in timing which represents a start of the specific period and punch-out timing which represents an end of the specific period are reset once the punch-in recording is done, the timing must be specified over again if the punch-in recording failed at the first attempt.

Also, when playing back recorded musical playing data, there is sometimes a need to play back only a desired portion, particularly, a need to play back the desired port ion repeatedly. In view of such needs, there has previously been proposed a sequencer (such as disclosed in U.S. Pat. No. 4,454,797) capable of specifying a particular section and playing back the specified section repeatedly.

However, in the above sequencer, it has not been. possible, during the playback of musical playing data, to specify a section to be played back repeatedly, and also, such a section has had to be specified by its bar number or the address at which data for that section is recorded. Therefore, the above sequencer has had the shortcoming that the bar or other number for the section to be repeated has to be checked up on the music. Also, since the sections can only be specified in blocks of bars, the above sequencer has had another shortcoming that when playing back syncopated music, the melody cannot be repeated as originally recorded.

Also, the sequencer can record musical playing data exactly as generated in actually played music, and for example, can record the change of tempo, etc. exactly as originally played. Therefore, when the recorded musical playing data is played back, the same music as originally played can be reproduced. This means that tempo data recorded not only at the start of the music but also in the middle of the music. In prior art, the sequencer has been designed so that tempo values, whether at the start or in the middle of music, are recorded directly as data (such as disclosed in Japan Patent Laid Open sho No. 63-193194, etc.).

However, since the tempo has to be coordinated throughout the music, when the tempo of the music speeds up or slows down, the tempo has increase or decrease throughout the whole music. In such a case, with the above prior art sequencer, all tempo data for the music have to be rewritten, which not only is extremely time and labor consuming but also involves troublesome work to calculate the amount of increase or decrease.

One possible solution to the above problem has been a method whereby a value is stored which indicates the degree of change from the current tempo to a new tempo. However, this method has had the shortcoming that when playing back music after skipping a prescribed amount of musical playing data by fast forward or other means, the tempo setting would be rendered totally improper if the prescribed amount of data contained tempo data which had not been read out because of the skipping of that amount of data.

SUMMARY OF THE INVENTION

It is a first object of the present invention tc, overcome the above problems by providing a musical playing data processor which is capable of setting a punch-in timing and a punch-out timing in real time, the timing being unerasable by punch-in recording operation.

A second object of the present invention is to provide a musical playing data processor which is capable of specifying during the playback of musical playing data (music) a section to be played back repeatedly and playing back the section repeatedly at the timing exactly as specified.

A third object of the present invention is to provide a musical playing data processor which is capable of maintaining a proper tempo setting by recording tempo data as a rate of change from an initial tempo value.

The musical playing data processor of the present invention allows the punch-in timing and punch-out timing to be specified during the playback of previously recorded musical playing data. During playback, since music is reproduced using musical playing data recorded from electronic musical instruments or the like, the player can specify the timing (by pressing switches, etc.) while listening to the music. The specified timing is stored in a storage means as the number of clock pulses. The number of clock pulses represents the number of clock signal counts, the clock signal being the minimum unit of the clock Generator output which provides the reference for the playback speed. During the next playback of musical playing data (when the punch-in recording mode is set), when the same number of pulses as that of the punch-in timing are counted, the recording state is entered which continues till the punch-out timing is reached (til the number of clock pulses corresponding to the punch-out timing are counted). During that period, the previously recorded data in that section is replaced with musical playing data of the music played in real time. Also, Since the punch-in timing and punch-out timing are stored in the storage means, the same recording operation can be redone as many times as desired till the punch-in recording is done satisfactorily.

Furthermore, the musical playing data processor of the present invention allows more than one phrase timing to be specified during the playback of previously recorded musical playing data. During playback, since music is reproduced using musical playing data recorded from electronic musical instruments or the like, the player can specify the timing (by pressing switches, etc.) while listening to the music. The specified timing is stored in the storage means as the number of clock pulses. The number of clock pulses represents the number of clock signal counts, the clock signal being the minimum unit of the clock generator output which provides the reference for the playback speed. During the next playback, when any of the thus set phrase timing is selected, the section between the specified phrase timing and the next phrase timing is played back repeated. Since the playback start timing and the playback end timing are both specified by the number of clock pulses, the timings can be specified accurately to a fraction smaller than one-tenth of a bar, therefore, a section to be repeated can be readily specified in a syncopated rhythm or in the middle of a small passage.

Also, In the musical playing data processor of the present invention, tempo data in the middle of music is stored as a rate of change from the initial tempo value which is a tempo value at the start of the music. The rate of change (tempo data) from the initial tempo value is calculated as follows:

$$DTMP = \left\{ \frac{TMP}{ITMP} - 1 \right\} \times 100$$

where

DTMP: Rate of change

ITMP: Initial tempo value

TMP: New tempo value

Since the initial tempo value at the start of music is always read out when running the music (even when skipping a portion of the music), once the value is buffered, the value can be referenced at any point in the middle of the music. Therefore, the change of tempo for the whole music can be easily accomplished by only changing the initial tempo value since the changed initial tempo value is always referenced. Also, even when a portion of the music is skipped by fast forward or other means, since the tempo is set with reference to the initial tempo value, the tempo setting can be made properly.

BRIEF DESCRIPTION OF THE DRAWINGS

FIGS. 3(A) to (G) are diagrams showing the formats of various data stored in the automatic playing memory.

FIG. 4 shows the configuration of a register group in the sequencer.

FIGS. 5(A) to 7(B) inclusive are diagrams showing pointers and explaining the contents of data stored in various registers in various modes.

FIGS. 8(A) to 9(C) inclusive are flowcharts illustrating the Operations of the sequencer embodying the present invention, wherein FIG. illustrates the main processing operation, FIGS. 9 to 17 inclusive illustrate subroutines executed by on/off operations of various key switches, and FIGS. 18(A)-(C) inclusive illustrate a clock interrupt operation.

DESCRIPTION OF THE PREFERRED EMBODIMENTS

Figure 1:
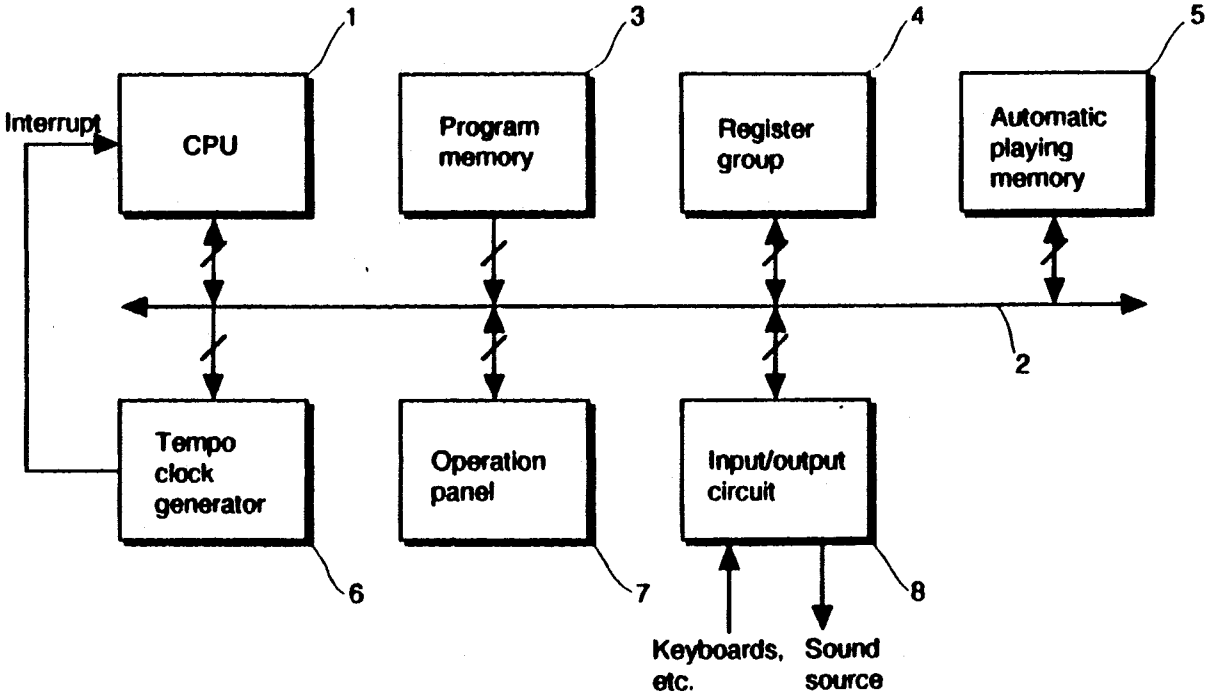
FIG. 1(A) is a block diagram of a control section of a sequencer in one embodiment of the present invention, and FIG. 1(B) a diagram showing the operation panel of the sequencer.
Figure 1:
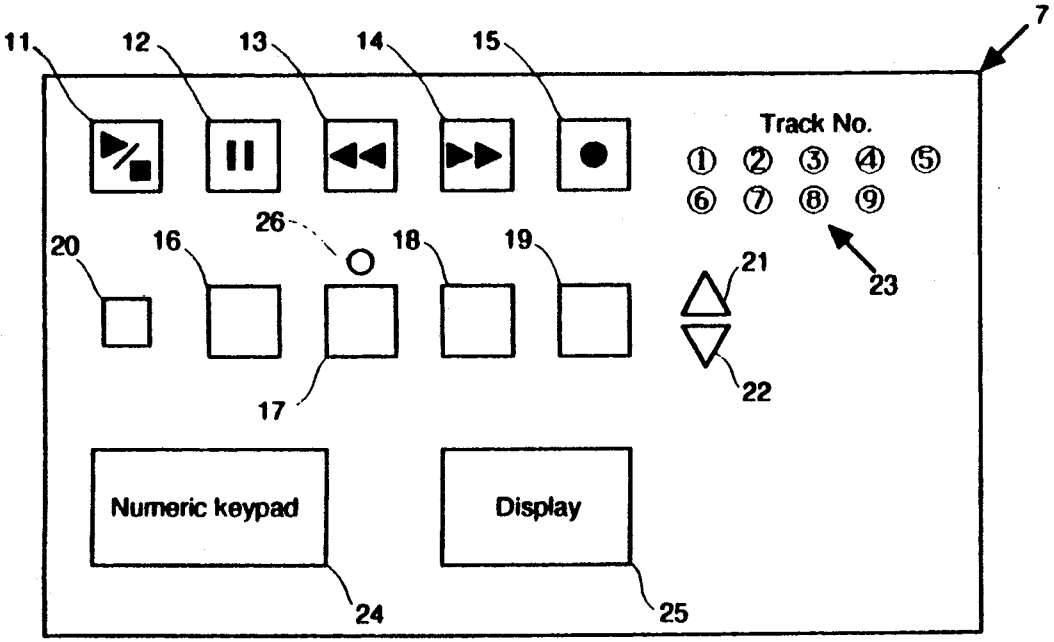

FIG. 1 (A) is a block diagram of a control section of a sequencer in one embodiment of the present invention, and FIG. 1 (B) is a schematic diagram showing the operation panel of the sequencer.

Referring to FIG. 1(A), a CPU 1 that controls the operations of the sequencer is connected to various operation sections via a bus 2. Connected to the bus 2 are program memory 3, a register group 4, an automatic playing memory 5, a tempo clock generator 6, an operation panel 7, and an input/output circuit 8. The program memory 3 consists of a ROM, while the register group 4 consists of a RAM. The automatic playing memory 5 consists of a battery backed-up RAM and a floppy disk drive. The input/output circuit 8 serves as a MIDI interface to receive musical playing data from musical playing apparatus such as keyboards in the form of MIDI code data and output recorded musical playing data (song data) to a sound generating source.

Referring to FIG. 1(B), the operation panel 7 of the sequencer is provided with a group of various switches and a display. The group of various switches include a start/stop switch 11, a pause switch 12, a rewind switch 13, a fast forward switch 14, a record switch (REC switch) 15, a phrase switch 16, a punch-in/punch-out switch 17, a song switch 18, a tempo switch 19, a function switch 20, a tempo-up switch 21, a tempo-down switch 22, a track No. switch group 23, and a numeric keypad 24. The display 25 is provided to display the number of bars and the number of beats contained in song data (musical playing data for a piece of music consisting of a plurality of tracks) during RUN state (during record mode or reproduction mode), while an LED 26 is provided in conjunction with the punch-in/punch-out switch 17.

Figure 2:
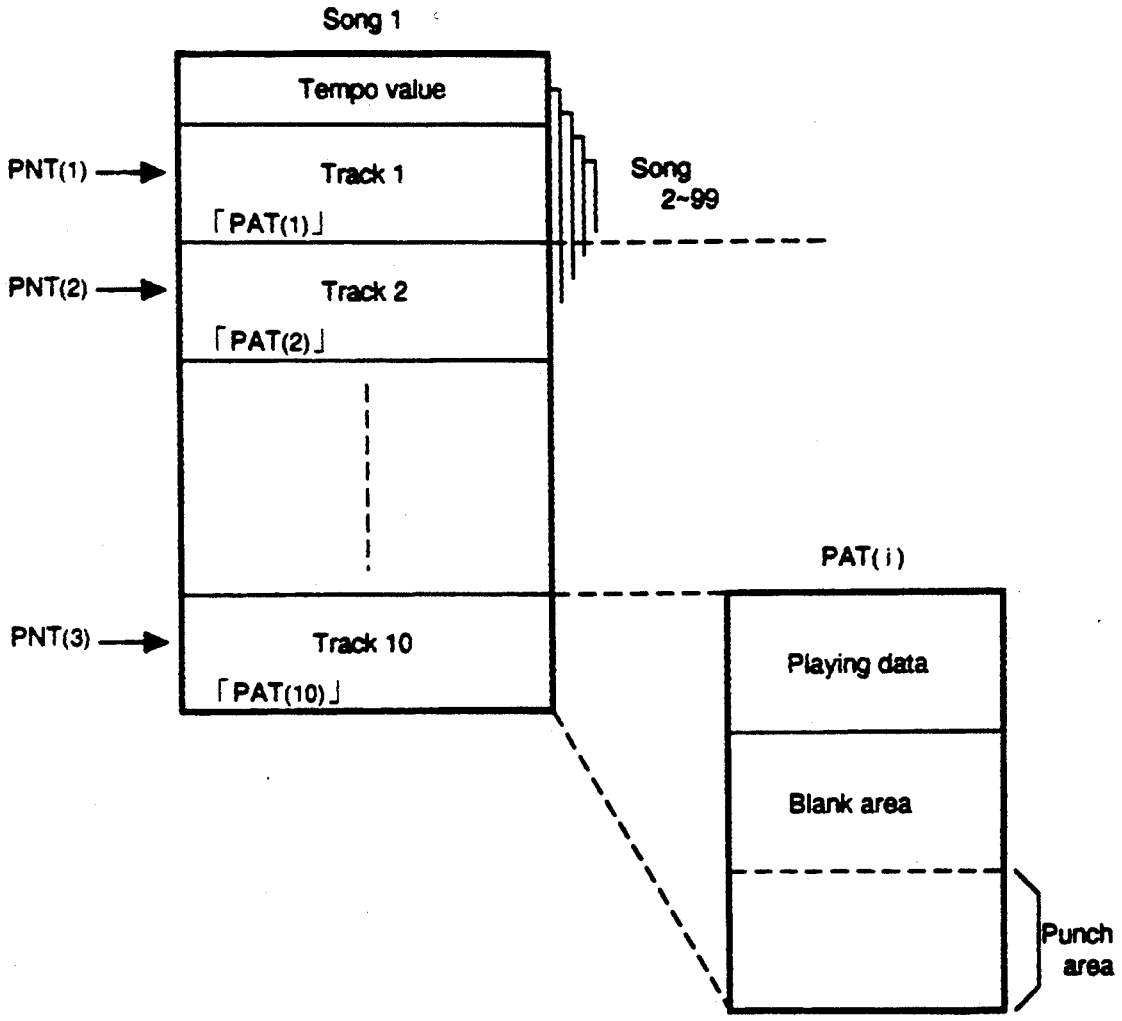
FIG. 2 is a diagram showing the configuration of an automatic playing memory of the sequencer.

FIG. 2 is a diagram explaining the configuration of the automatic playing memory 5. The automatic playing memory 5 is capable of storing data for 99 songs (song numbers 1-99). Each song data storage area comprises an initial tempo value storage area and 10 tracks (part data storage areas: track Nos. 1-10). Musical playing data for individually independent parts are recorded on the respective tracks, the parts being performed simultaneously during RUN. Each track comprises a musical playing data storage area, a blank area for storing accompanying data, and a punch area. The punch area is an area for buffering new musical playing data written during punch-in recording. In this embodiment, each track is hereinafter represented by a group of storage areas which are identified by PAT(i)(i=1-10), while the pointer that indicate musical playing data to be read out as the music progresses is represented by PNT(i)(i=1-10).

FIGS. 3 (A)-(/G) are diagrams showing the formats of musical playing data recorded on the tracks. FIGS. 3 (A), (B), (E), and (F) show event data formats for key-in, key-off, tempo-up, and tempo-down, respectively, while FIGS. 3(C) and (D) show formats of data (duration data: clock data) for intervals (number of clock pulses) between adjacent events. The long duration data shown in FIG. 3(D) is used when storing an interval exceeding one bar. Usually, event data and duration data are recorded alternately, but in the case of simultaneous depression of keys for playing a chord, etc., the concurrently occurring event data are recorded without inserting duration data between them. Tempo-up and tempo-down event data can only be recorded on track No.10. This means that track No.10 is usually used for recording a rhythm part, the rhythm tempo being controlled by the musical playing data recorded on this track.

We will now describe the functions of the switches on the operation panel 7 as well as the functions of the sequencer.

The start/stop switch 11 is a switch used to start and stop RUN, i.e. writing to and reading from the automatic playing memory 5.

When RUN is started, writing and reading operations are performed on the song data of the selected song number: musical playing data is written in tracks (i) for which the record mode (REC(i)=1: hereinafter described) has been set, while recorded musical playing data is read from tracks (i) for which the play mode (PLY(i)=1: hereinafter described) has been set.

The pause Switch 12 is a switch used to temporarily stop the operation during the reading of song data and to release the pause mode to resume the reading operation.

The rewind switch 13 and the fast forward switch 14 are used to run the reading of song data at fast speed in the reverse and forward direction respectively. In practice, this is accomplished by increasing the tempo clock frequency.

The pause switch 12, the rewind switch 13, and the fast forward switch 14 are all disabled while writing is performed on any one of the tracks (REC(i)=1 and PNT(i)≠-1: hereinafter described).

The record switch 15 is depressed together with one of the track No. switches hereinafter described, to set the record mode (REC(i)=1: hereinafter described) for that track.

The phrase switch 16 is a switch used to set a phrase point in the middle of music and to start reading from the thus set phrase point.

When the phrase switch 16 is depressed together with the function switch during the reading of song data (during automatic playing of music), a phrase point is set at that timing. By pressing the phrase switch, numeric keys (1-9), and pause key in this order prior to the reading of song data, the reading of song data from the phrase point entered using the numeric keys to the next phrase point is performed repeatedly.

The punch-in/punch-out switch 17 is a switch used to replace a portion of previously recorded musical playing data with a new piece of musical playing data (punch-in record mode). When this switch is turned on during the reading of song data, a punch-in timing is set, and when the switch is turned on again during the subsequent reading of song data, a punch-out timing is set. The section sandwiched between the punch-in timing and the punch-out timing is the punch-in section. After thus setting the punch-in section, when RUN is performed with the record mode set for the track on which the musical playing data to be replaced is recorded, the track is placed in the record mode for the punch-in section only, during the reading of song data.

The LED 26 provided in conjunction with the above switch 17 is a display for displaying various stages of the punch-in record mode. The normally off LED 26 comes on flickering when a punch-in timing is set, and stays lit when a punch-out timing is set. Thereafter, when music is started and the punch-in record mode is entered, the LED 26 starts flickering, and when the punch-in section is released (the release is accomplished at the third activation of the punch-in/punch-out switch), the LED 26 goes off.

The song switch 18 is a switch used to select the song number. With this switch turned on, a two-digit number is entered using the numeric keys to select the song of that number.

The tempo switch 19 is a switch used to enter tempo data from the numeric keys. With this switch turned on, a number (20-30) is entered using the numeric keys to set the tempo with that number.

Also, when the tempo-up switch 21 or the tempo-down switch 22 is turned on, the tempo can be set at a desired value by referencing the initially set tempo.

The track No. switch group 23 consists of 10 key switches having designations of numbers 1-10, which are used to set and reset the play mode or record mode for the respective tracks of selected song data. As previously noted, when the track No. switch of a desired number is depressed together with the record switch 15, the record mode is set for that track number. On the other hand, when the track No. switch is pressed singly, the current state (set or reset) of the play mode is reversed for that track number.

Also, the display 25 is used to display the number of bars, the number of clock pulses, etc. during playback and recording.

Figure 5:
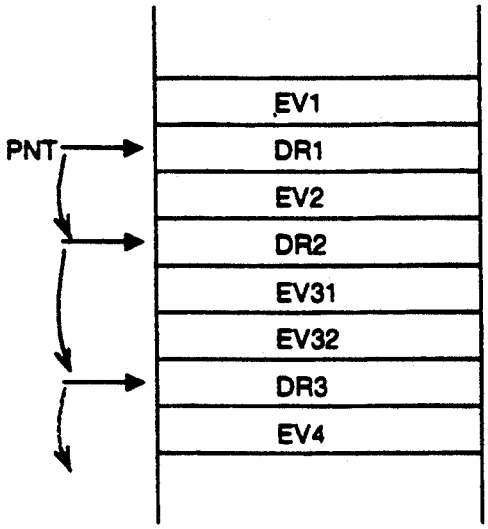
Figure 5:
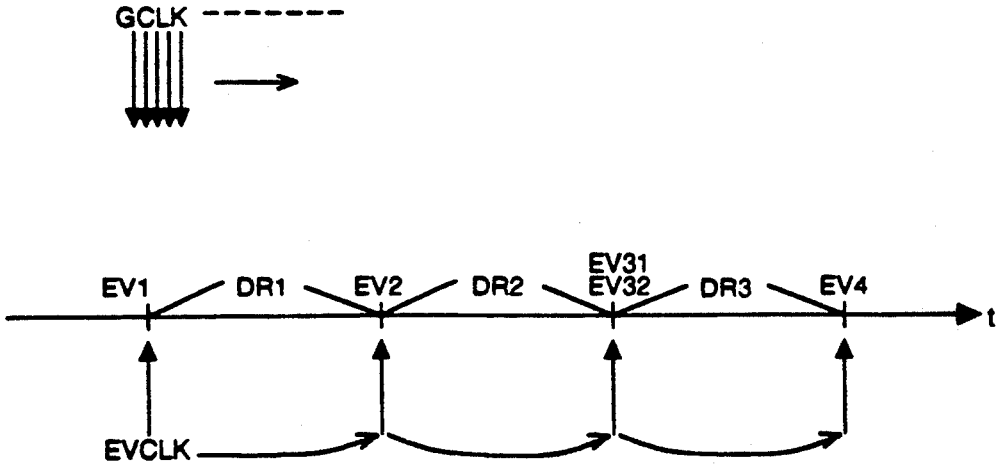
Figure 6:
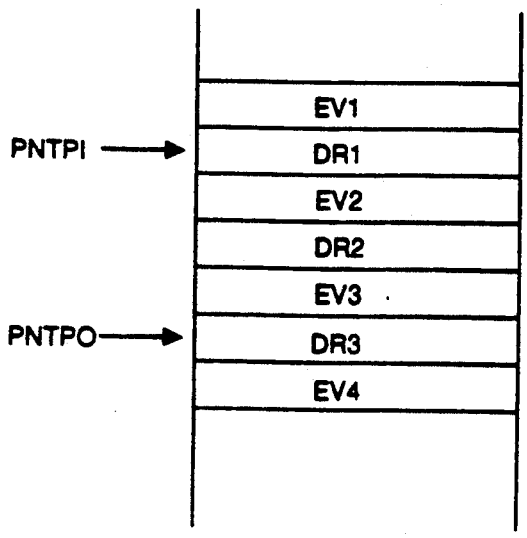
Figure 6:
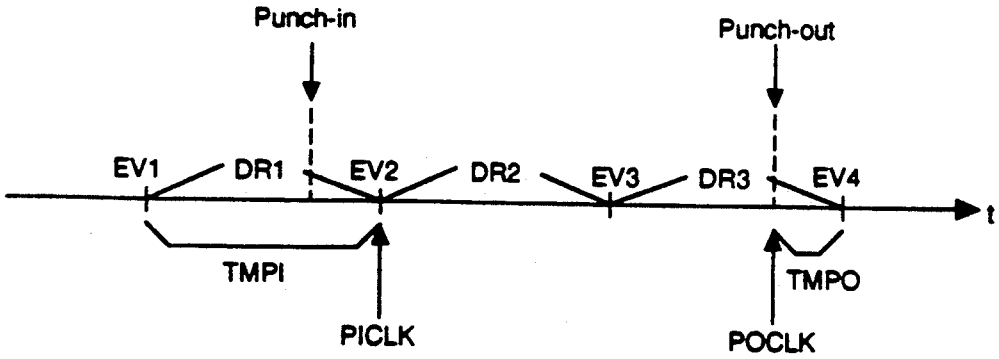
Figure 7:
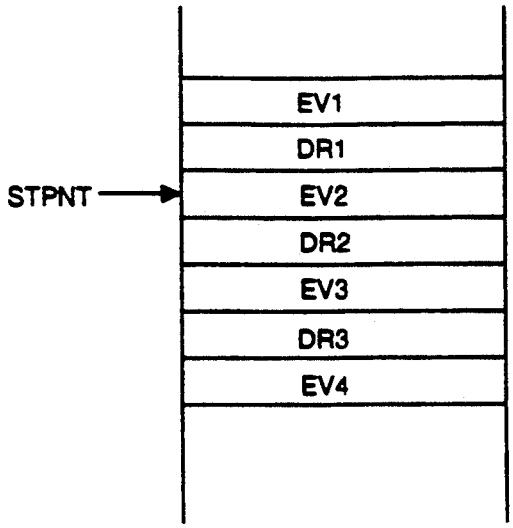
Figure 7:
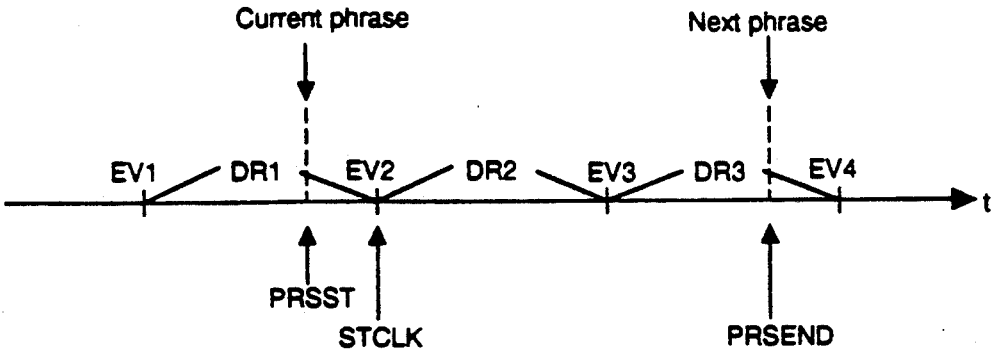

FIG. 4 shows registers comprising the register group 14. These registers are used for the following purposes. Also, FIGS. 5 to 7 show in a conceptual form what values are stored in the registers.

SONG: Song number register—Stores selected song number (=1-99).

RUN: RUN flag—Set during reading/writing of song data.

PSE: Pause flag—Set when the clock is temporarily stopped during RUN (when reading/writing of song data is temporarily stopped).

STP: Run direction register—Set to "1" during reading in forward direction and "−1" during reading in reverse direction (during rewind). Based on this value, a general clock counter GCLK (hereinafter described) is counted.

FR: Fast forward flag—Set when high-speed feeding in the forward or reverse direction is performed by pressing the fast forward switch 14 or the rewind switch 13.

TMP: Tempo value register—Stores tempo during RUN. Based on this data, the tempo clock generator is controlled.

TMP1: Initial tempo value register—Stores the initial tempo value data recorded at the top of song data when a song is selected.

DTMP: Tempo change rate register—When a new tempo value is set in song data, the rate of change calculated with respect to the initial tempo value is stored in this register. This tempo change rate is recorded on track No.10 as tempo-up event data or tempo-down event data.

PRS: Phrase mode flag—Set during the phrase mode (mode for playing back a specified phrase section repeatedly).

PNC: Punch mode flag—A three-state flag that takes three values 0, 1, and −1, "0" indicating the normal state when no punch-in sections are set, "1" indicating that a punch-in section is already set but not in the state of punch-in recording, and "1" indicating that the punch-in section is in the state of punch-in recording.

GCLK: General tempo clock counter—Counts tempo clock pulses from the top of song data. (See FIG. 5)

PICLK and POCLK: Punch-in timing clock register and Punch-out timing clock register—Registers to store clock values for punch-in timing and punch-out timing. (See FIG. 6)

PNTPI(i) and PNTPO(i) (i=1-10): Punch-in timing pointer and Punch-out timing pointer Used to store pointer PNT (i) (FIG. 2) locations (addresses) for punch-in timing and punch-out timing, respectively. Pointer PNT (i) always indicates duration data. Therefore, PNTPI (i) and PNTPO (i) indicate duration data to which the clock values of punch-in timing and punch-out timing respectively belong. (See FIG. 6)

TMPI(i): Punch-in event deviation register Stores the number of clock pulses counted from the event immediately preceding the punch-in timing. (See FIG. 6)

TMPO(i): Punch-out event deviation register Stores the number of clock pulses counted until reaching the event immediately succeeding the punch-out timing. (See FIG. 6)

TMPI(i) and TMPO(i) are used to identify the punch-in section during the punch-in record mode.

EVCLK(i): Event clock register—Stores a clock value for the next event during RUN. When this value matches GCLK, the next event is executed. (See FIG. 5)

REC (i), PLY (t): Record mode register, Play mode register—During RUN of song data, writing is performed on tracks for which REC=1 is set (except when PNC=1), and reading is performed from tracks for which PLY=1 is set. By combining these modes, it is possible to write musical playing data into a certain track by playing keyboards, etc. while musical playing data on another track is being played back (multiple recording).

PRSBUF(n) (n=1-9): Phrase register—Stores clock values (GCLK values) corresponding to the phrase numbers 1-9. When the phrase switch 16 is turned on during RUN, the clock value corresponding to that timing is stored in this register as a phrase point. Nine phrase points 1 to 9 can be stored, and are sorted, when stored, in ascending order from 1 to 9 according to the clock value size.

PRSST, PRSEND: Phrase start clock value register, Phrase end clock value register—Registers to store phrase start clock value and phrase end clock value specified when the phrase mode is set. The start clock value is the clock value stored in PRSBUF(n) for the specified phrase n, while the end clock value is the clock value stored in PRSBUF(n+1). (See FIG. 7)

STPNT (n, i): Phrase start pointer—Stores pointer PNT (i) (FIG. 2) location (address) for phrase point. (See FIG. 7)

STCLK(n,i): Phrase start event deviation register—Stores the number of clock pulses counted from the event immediately preceding the phrase point. (See FIG. 7)

STPNT(n,i) and STCLK(n,i) are set for all tracks for every phrase point.

We will now explain the operations of the sequencer with reference to the flowcharts of FIGS.8 to 18.

Figure 8:
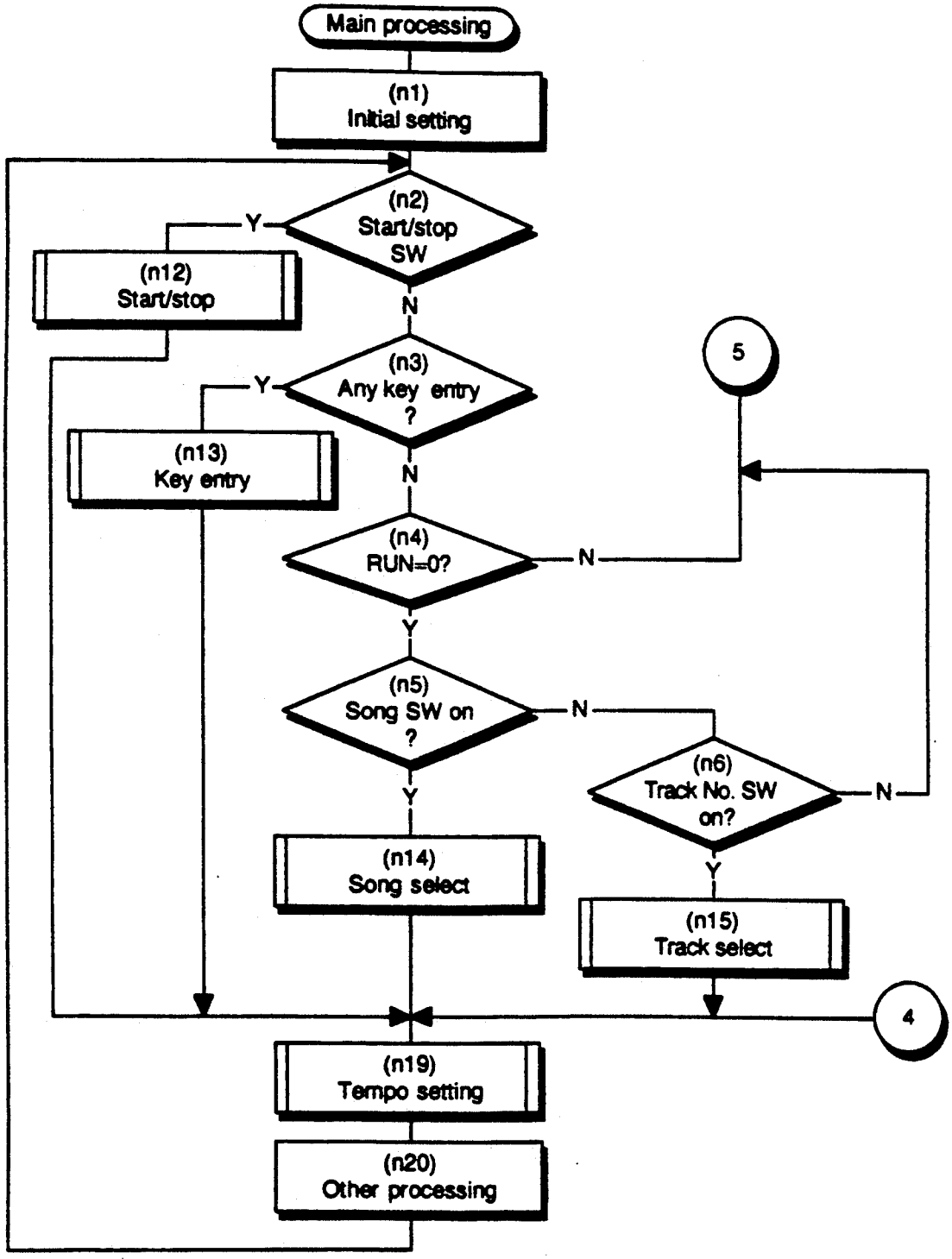
Figure 8:
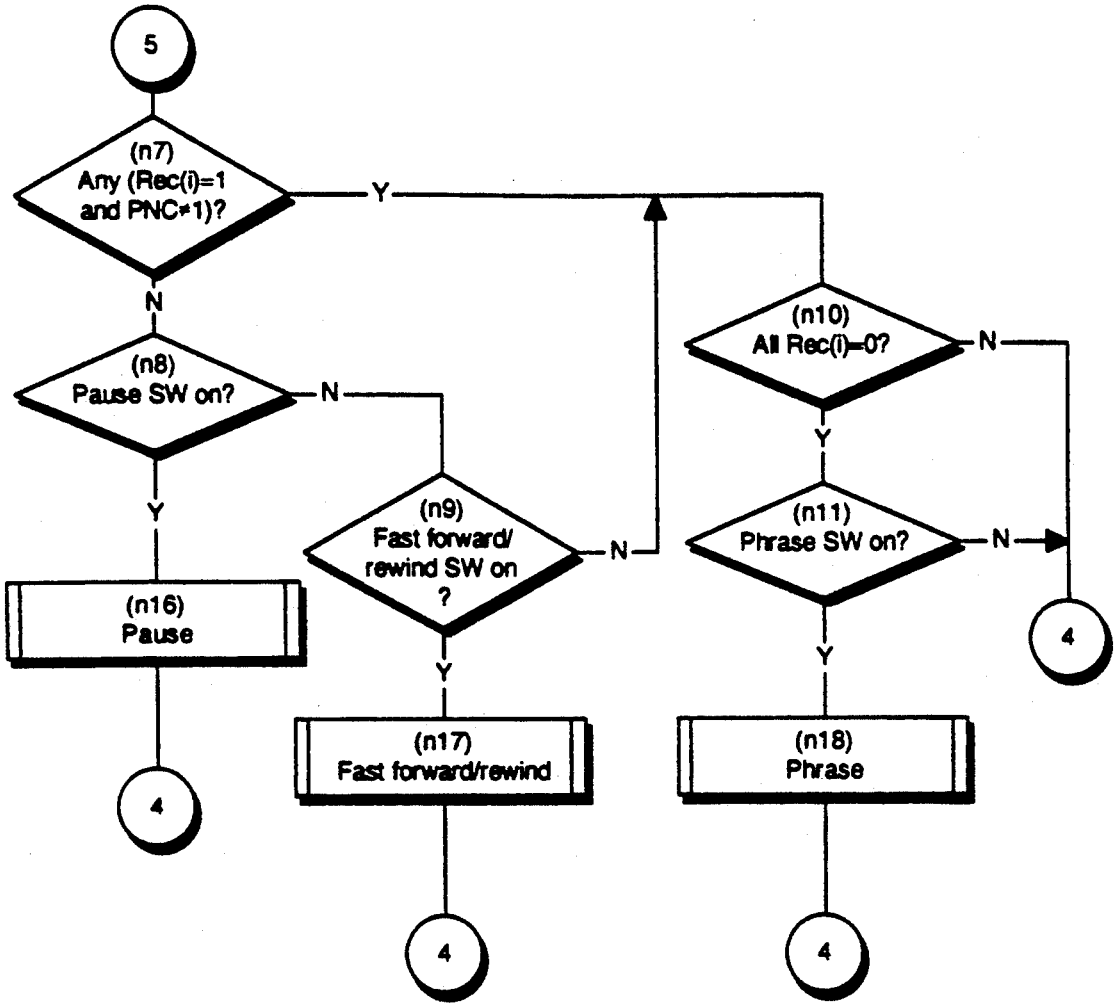

FIGS.8 (A) and 8(B) show the main processing operation. When power is turned on to the sequencer, first the initial setting is done in n1. This initial setting clears all registers and resets all flags to 0. In this situation, on/off events are examined on all switches (n2-n11). When any switch on event (on/off event in the case of the fast forward switch and the rewind switch) is detected in this process, the corresponding subroutine is executed. For example, when a start/stop switch on event is detected (n2), the start/stop subroutine (n12: see FIG. 11) is executed, and, when a key entry from the input/output circuit 8 is detected (n3), the key entry subroutine (n13: see FIG. 16) is executed. Also, when the RUN flag is 0, that is, reading/writing of song data is not being performed, if a song switch on event (n5) or a track No. switch on event (n6) is detected, the song select subroutine (n14: see FIG. 9) or the track select subroutine (n15: see FIG. 10) is executed.

Figure 15:
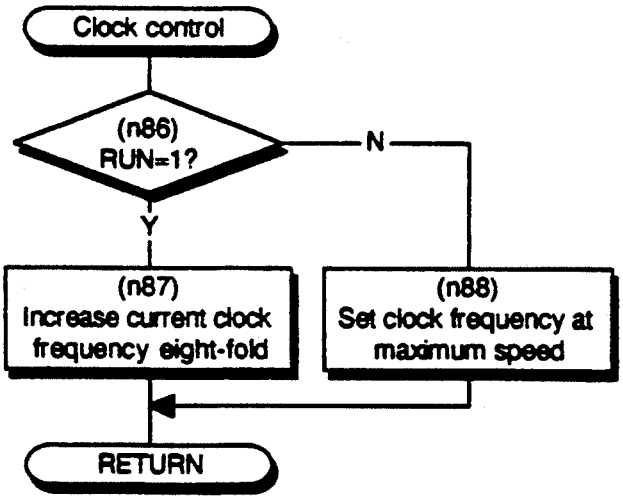

When no writing is currently performed on any one of the tracks, that is, when REC(i)=1 and PNC≠1 is not true for any i (n7), the condition is Judged as a pause switch on event (n5) or an on/off event of the fast forward switch or the rewind switch (n9). On the other hand, if REC(i)=1 or PNC≠1 is true for any i, this means that writing is being performed, and therefore, fast forward, rewind, and pause are disabled. When the condition is judged as a pause switch on event, the pause subroutine (n:16: see FIG. 12) is executed. When the condition is judged as an on/off event of the fast forward switch or the rewind switch, the fast forward-/rewind subroutine (n17: FIG. 15) is executed.

On the other hand, only when REC(i) is reset for all tracks, an on event of the phrase switch is accepted (n10, n11). When an on event of the phrase switch is accepted, the phrase subroutine (n18: see FIG. 14) is executed.

Thereafter, in all cases, the tempo setting subroutine (n19: see FIG. 17) is executed, and after performing the main volume control and other operations (n20), the process returns to n2 to repeat the same procedure.

Figure 9:
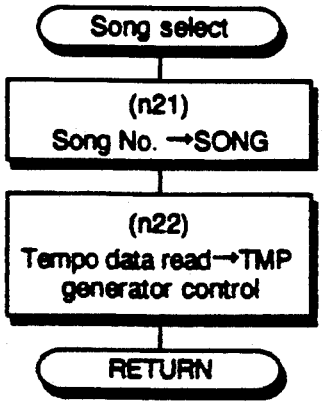

FIG. 9 illustrates the song select subroutine. The procedure starts by storing in the SONG register a two-digit song number entered from the numeric keys (n21). Next, the song data specified by the song number is read from the automatic playing memory 5, and the initial tempo value recorded at the top of the data is stored in the TMP register to control the tempo clock generator 6 with that tempo (n22).

Figure 10:
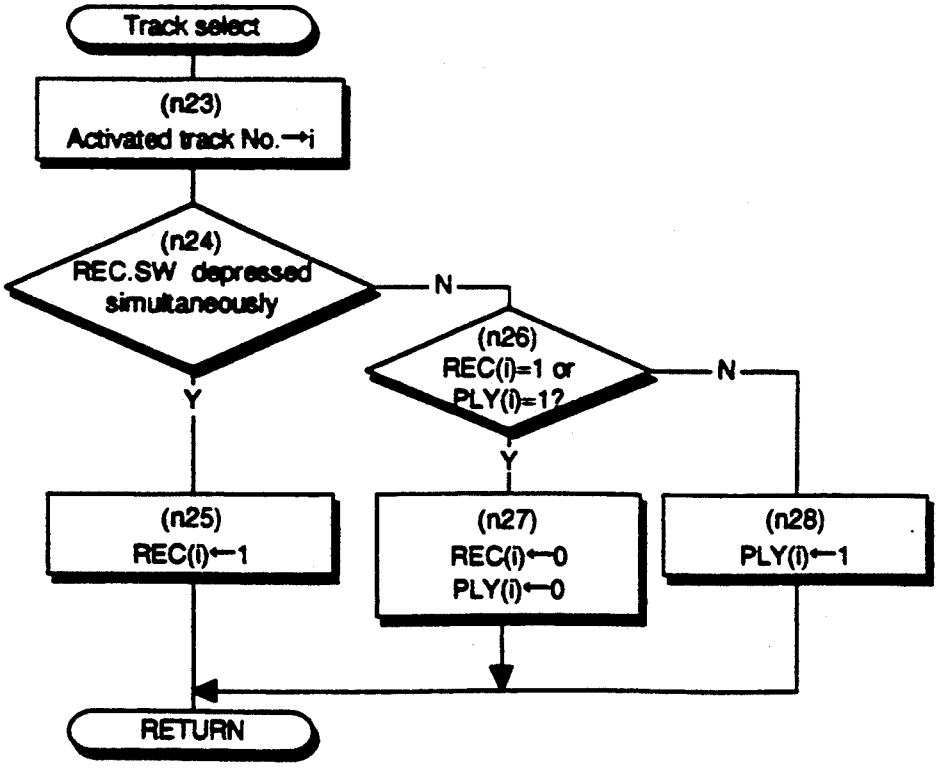

FIG. 10 illustrates the track select subroutine. First, the activated track No. switch (track No.) is detected and stored in the track pointer i (n23). Next, it is judged whether the track No.. switch is depressed together with the record switch (n24), and if yes, the record flag REC(i) is set to set the record mode for the designated track (n25). On the other hand, when the track No. switch is depressed singly, the REC(i) flag and the play flag PLY (i) for the designated track No. are examined, and if either one of the flags is set, both flags are reset (n27) and the process returns to the main routine. If both are reset, the PLY(i) is set (n28) and the process returns to the main routine. This means that the play mode is switched on and off alternately as the track No. switch is pressed alone repeatedly.

Figure 11:
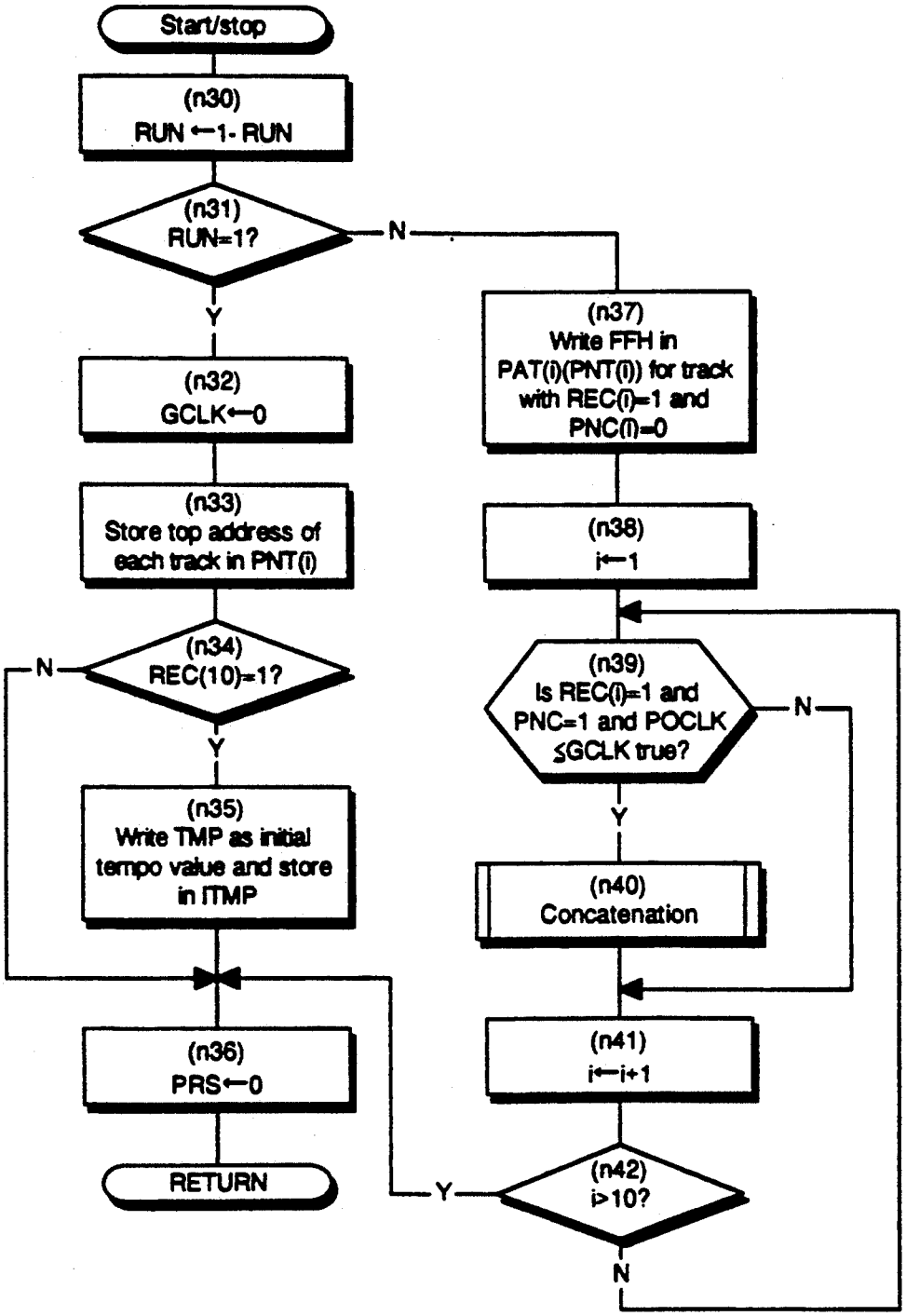

FIG. 11 illustrates the start/stop subroutine. When the start/stop switch is turned on, first the RUN flag is toggled (n30). As a result of the toggling, if the RUN flag is set (=1), the operation starting with n32 is executed, and if the RUN flag is reset (=0), the operation starting with n37 is executed (n31).

Since the RUN flag being set to 1 as a result of the toggling means that writing/reading is started, first the general tempo clock counter GCLK is cleaned (n32), and the top address of each track i of the designated song number is stored in the pointer PNT(i)(i=1-10) (n33). Next, the status of REC(10) is examined (n34). If this flag is set, it means a tempo setting change, and therefore, the contents of the TMP register (currently stores the initial tempo value) are written to the top of the track, the contents being stored at the same time in the initial tempo value register ITMP (n35). After that, the phrase mode flag PRS is reset (n35) and the process returns to the main routine. In n34, if REC (10) is reset, the process jumps from n34 to n36.

On the other hand, when the RUN flag is reset as a result of the toggling in n30, the process Jumps from n31 to n37 to process termination of the operation. In n37, an end code $FF_H$ is written to the end of the track (i) for which REC(i)=1 and PNC(i)=0 is true, that is, to PAT(i) (PNT(i)) (the address area designated by the pointer PNT (i), i.e. the part data storage area PAT (i) corresponding to the track). Next, a search is made to find out a track for which punch-in recording is completed (n38, n39, n41, n42), and if a track for which punch-in recording is completed is found, concatenation is made with previously recorded musical playing data (n40). Completion of punch-in recording means that the current state is the punch-in record mode (REC(i)=1 and PNC(i)=1) with the count value by the general clock counter being equal to or having exceeded the punch-out timing clock value (POCLK=<GCLK). Concatenation means that the previously recorded musical playing data immediately preceding the punch-in timing is connected to the punch-in recorded musical playing data which is further connected to the previously recorded data succeeding the punch-out timing, after which new contiguous addresses are assigned. After the above operation, the process proceeds to n36.

Figure 12:
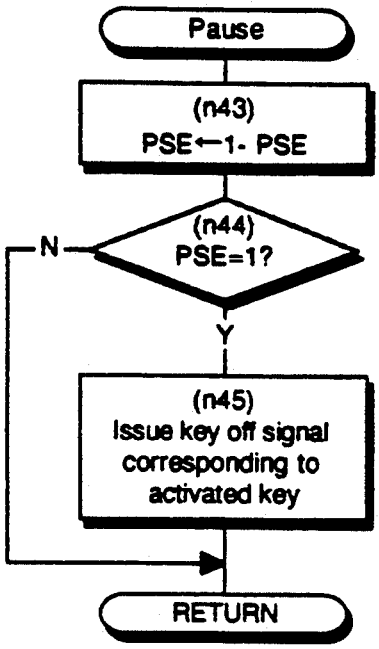

FIG. 12 illustrates the pause subroutine. When the pause switch is turned on, the PSE flag is toggled (n43). If the PSE flag is set as a result of the toggling (n44), a key off signal corresponding to the activated key is issued (n45) and the process returns to the main routine. If the PSE flag is reset as a result of the toggling, the process immediately returns to the main routine. A key off signal is issued to stop sound reproduction since during pause a key off event does not occur for the key generating the sound.

Figure 13:
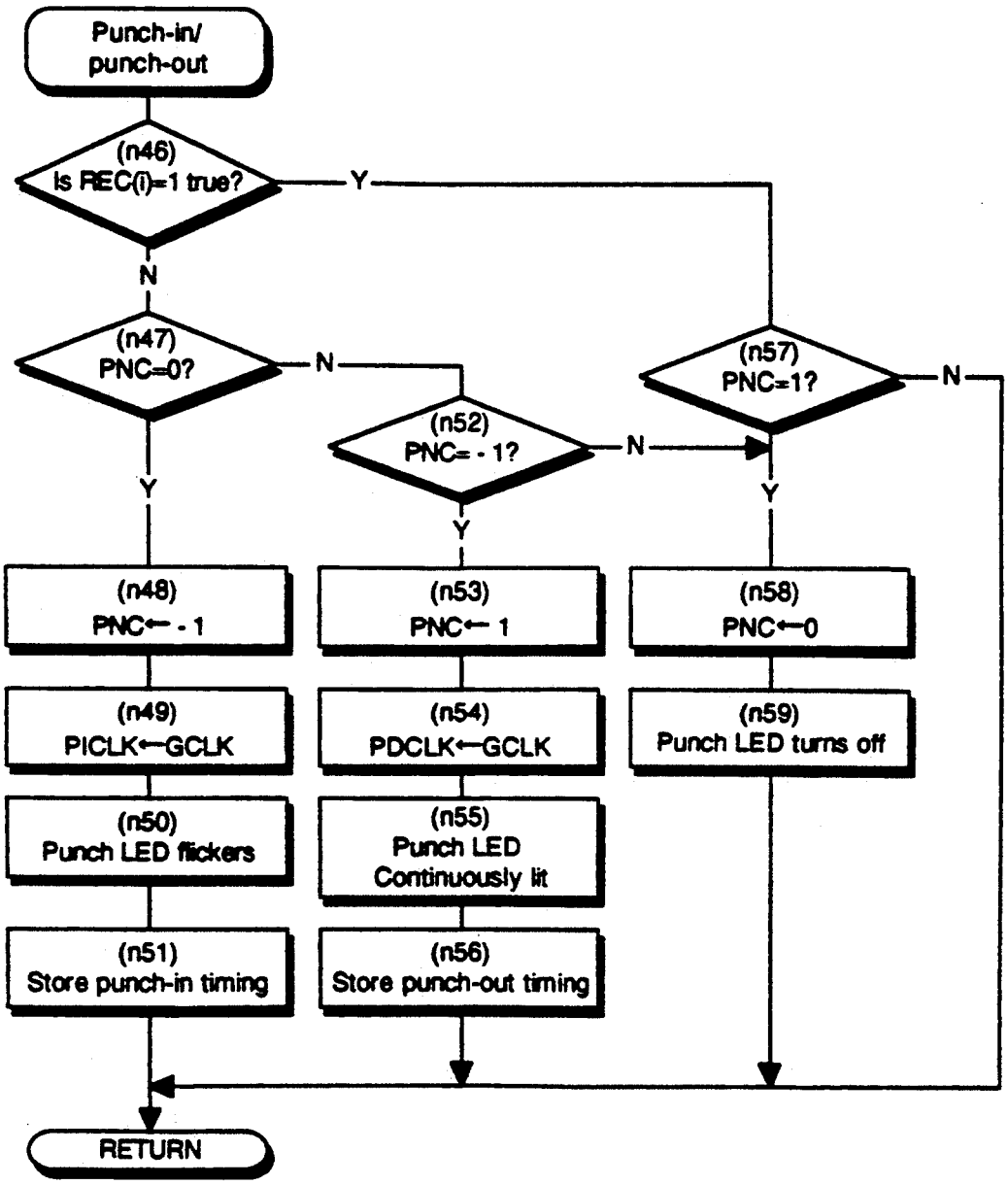

FIG. 13 illustrates the punch-in/punch-out subroutine. Usually, the punch-in/punch-out switch is turned on during playback of music (during reading of song data in play mode). When the punch-in/punch-out switch is turned on, first it is judged whether writing is currently being performed (n46, n57). That is, if PNC≠1 in record mode, it means that musical playing data is currently being written, and therefore, the process immediately returns to the main routine, disregarding the on event of the punch-in/punch-out switch. On the other hand, when PNC≠1, that is, when the switch is turned on while a punch-in section is already set (n46→n47, n46→n47→52), the punch-in record mode is released. That is, 0 is set in the PNC flag, the LED is turned off (n59), and the process turns to the main routine.

If there are no tracks with REC(i)=1 (means all tracks are in read mode) and PNC=0 is true (n46, n47), this means the setting of a punch-in timing. Therefore, −1 indicating the start of a punch-in section is set in PNC (n48), and the current value of the general tempo clock counter GCLK is stored in the punch-in timing clock register PICLK (n49). Next, the LED is put in a flickering condition (n50), the current value of the pointer PNT (i) is stored in the punch-in timing pointer PNTPI(i) for all tracks while storing in the punch-in event deviation register TMPI(i) the number of clock pulses (=GCLK−(EVCLK(i)−PAT (i) (PNT (i)) deviating from the immediately preceding event (n51), and the process returns to the main routine.

On the other hand, if there are no tracks with REC(i)=1 (means all tracks are in read mode) and PNC=−1 is true (n46, n52), this means the setting of a punch-out timing. Therefore, 1 indicating the end of a punch-in section setting is set in PNC (n53), and the current value of the general tempo clock counter GCLK is Stored in the punch-out timing clock register POCLK (n54). Next, the LED is turned off (n55), the current value of the pointer PNT(i) is stored in the punch-out timing pointer PNTPO (i) for all tracks while storing in the punch-out event deviation register TMPO(i) the number of clock pulses (=EVCLK(i)−GCLK) deviating up to the immediately succeeding event (n56), and the process returns to the main routine.

Figure 14:
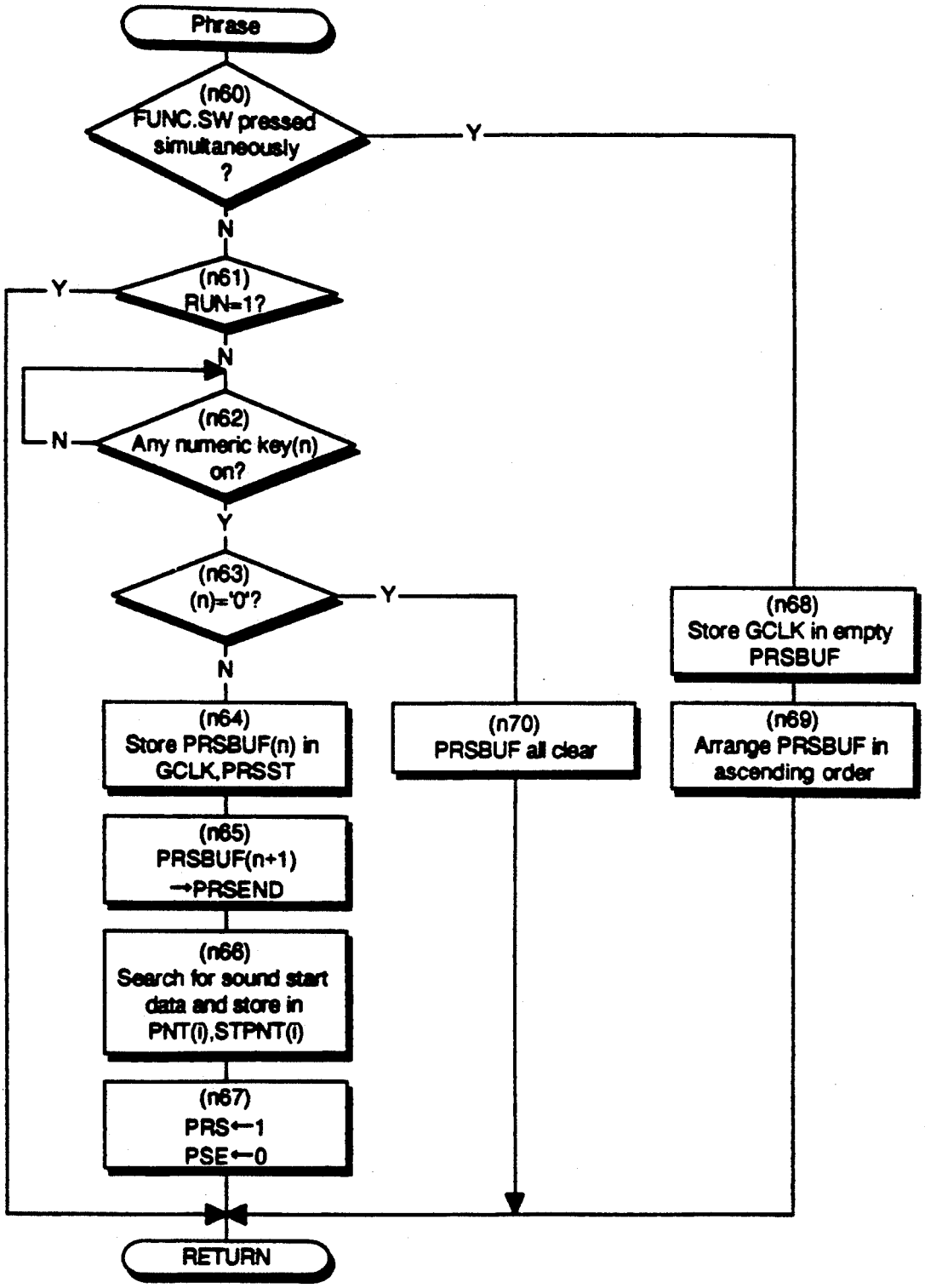
Figure 15:
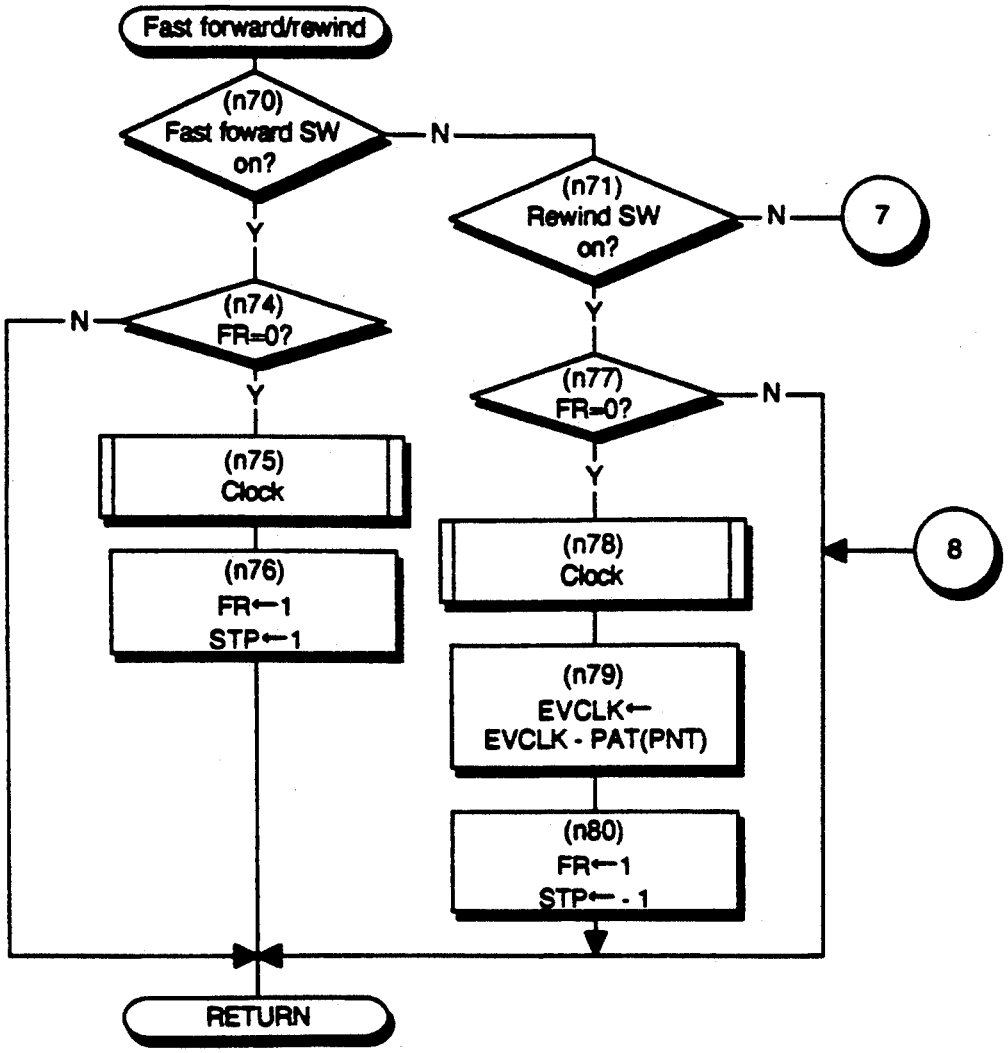
Figure 15:
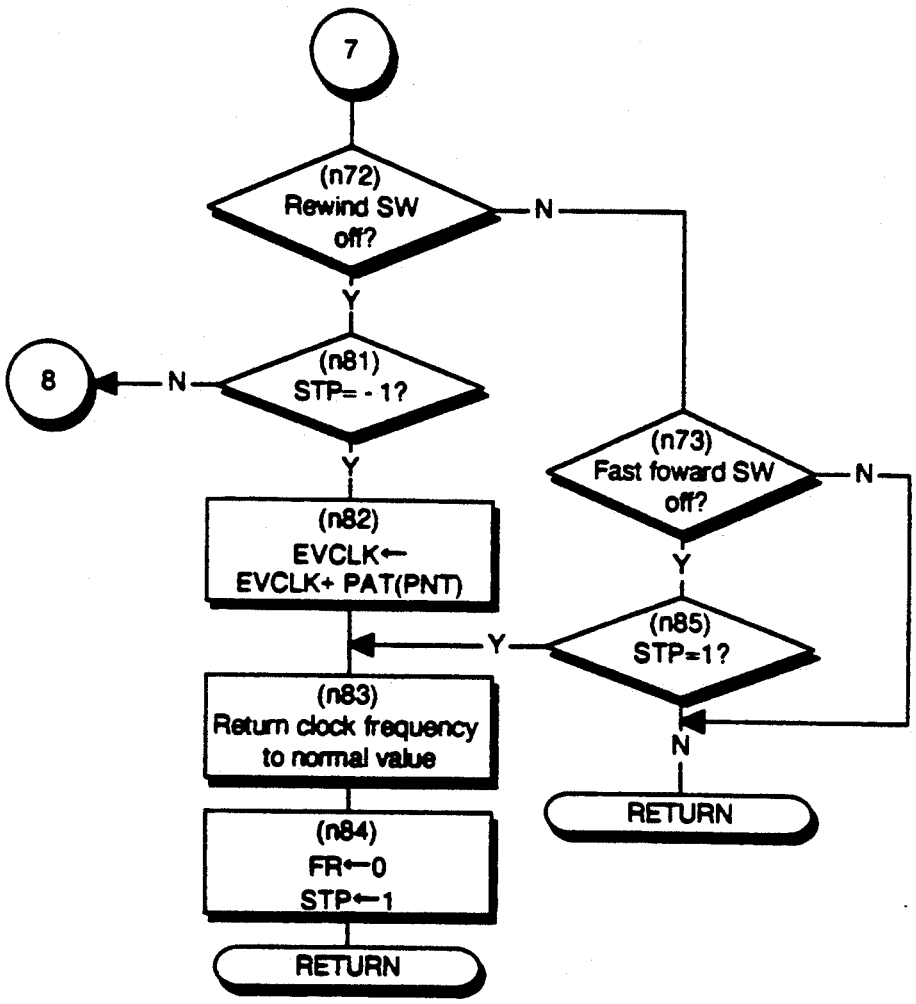

FIG. 14 illustrates the phrase subroutine. When the phrase switch is turned on, it is Judged whether the switch is depressed together with the function switch (n60). If yes, this means the setting of a phrase point, and therefore, the current value of GCLK is stored in an empty PRSBUF(n). After storing the value, the contents of PRSBUF(n) are arranged in ascending order (n69) and the process returns to the main routine.

If it is Judged as a single depression of the phrase switch, this means the setting of the phrase mode, and therefore, the status of the RUN flag is examined (n61). If the RUN flag is set, this means that data read/write is currently in progress, and therefore, the process returns to the main routine without setting the phrase mode. If the RUN flag is reset, a phrase number n entry from the numeric keys is accepted in n62, and it is judged if the entered key number is 0 (n63). If 0 is entered, it means the operation to clear all previously set phrase buffers PRSBUF, and this operation is performed in n70, after which the process returns to the main routine.

When an n value other than n=0 is entered, the value of PRSBUF(n) is stored in GCLK and also in the phrase start register PRSST (n64), while the value of PRSBUF(n+1) is stored in the phrase end register PRSEND (n65). Next, the address of the duration data at the start of the phrase on each track is stored in PNT(i) and STPNT(i) (n66). The data represented by this address is located by reading duration data sequentially from the start and finding one where PRSST is exceeded. After that, the phrase mode flag PRS and the pause mode flag PSE are both set (n67) and the process returns to the main routine.

To start the reading in the phrase mode, the pause switch is pressed to release the pause mode. At this time, if the start/stop switch is turned on, playback starts from the top of the music, disregarding the address set by the phrase subroutine.

FIG. 15 illustrates the fast forward/rewind subroutine. This operation is performed when an on/off event of the fast forward switch or rewind switch is detected. In n70–n73, it is judged which switch has generated the on/off event. In the case of an on event of the fast forward switch, the process Jumps from n70 to n74 where it is Judged whether the FR flag is reset. If the FR flag is set, it means that rewinding is currently being performed, and therefore, the process returns to the main routine, disregarding the on event of the fast forward switch. If the FR flag is reset, the clock control subroutine (see FIG. 15(C)) is executed (n75).

In the clock control subroutine (FIG. 15(C)), first the status of the RUN flag is examined (n86). If the flag is set, it means that reading is currently being performed, and therefore, the clock frequency is set at a value eight times higher than the normal frequency so that fast forward or rewind is performed at an audible speed (n87), after which the process returns to the fast forward/rewind subroutine. If the RUN flag is reset, it means that reading is not being performed, and therefore, the clock frequency is set at the maximum speed (n88) and the process returns to the fast forward-/rewind subroutine.

After exiting the clock control subroutine, the FR flag is set at the same time that 1 is set in the STP register (n76), after which the process returns to the main routine.

When an on event of the rewind switch occurs, the process jumps from n71 to n77 where it is judged whether the FR flag is reset. If the FR flag is set, it means that fast forward operation is currently being performed, and therefore, the process immediately returns to the main routine, disregarding the on event of the rewind switch. If the FR flag is reset, the clock control subroutine is executed in n78, and the clock value for the immediately preceding event occurrence is stored in the event clock register EVCLK for all tracks (i) so that event data are read in reverse order (n79). That is, since EVCLK (i) currently holds the clock timing for the next event, PAT(i) (PNT(t)) is subtracted to make it the clock timing for the immediately preceding event. Next, the FR flag is set, −1 is set in the STP register (n50) and the process returns to the main routine.

On the other hand, when an off event of the rewind switch occurs, the process Jumps from n72 to n51 where it is judged whether STP is −1. If STP is not −1, it means that rewinding is currently not being performed, and therefore, the process returns to the main routine, disregarding the off event. If STP is −1, it means that rewinding is currently being performed, and therefore, the operation starting with n82 is performed to release the rewinding operation. First to set a clock value for the next event (in forward direction) in the event clock, the current PAT(i) (PNT(i)) is added to all EVCLK(i) (n82), and the clock frequency is returned to the normal value to resume reading with a normal tempo (n83). After that, the FR flag is reset, 1 is set in STP (N84), and the process returns to the main routine.

When an off event of the fast forward switch occurs, the process Jumps from n73 to n85 where it is judged whether STP is 1. If the STP register is 1, it means that fast forward is currently being performed, therefore, the process proceeds to n83 to release the fast forward operation and to resume the normal reading operation. If the STP register is not 1 (if it is −1), it means that rewinding is currently being performed, and therefore, the process returns to the main routine, disregarding the off event.

Figure 16:
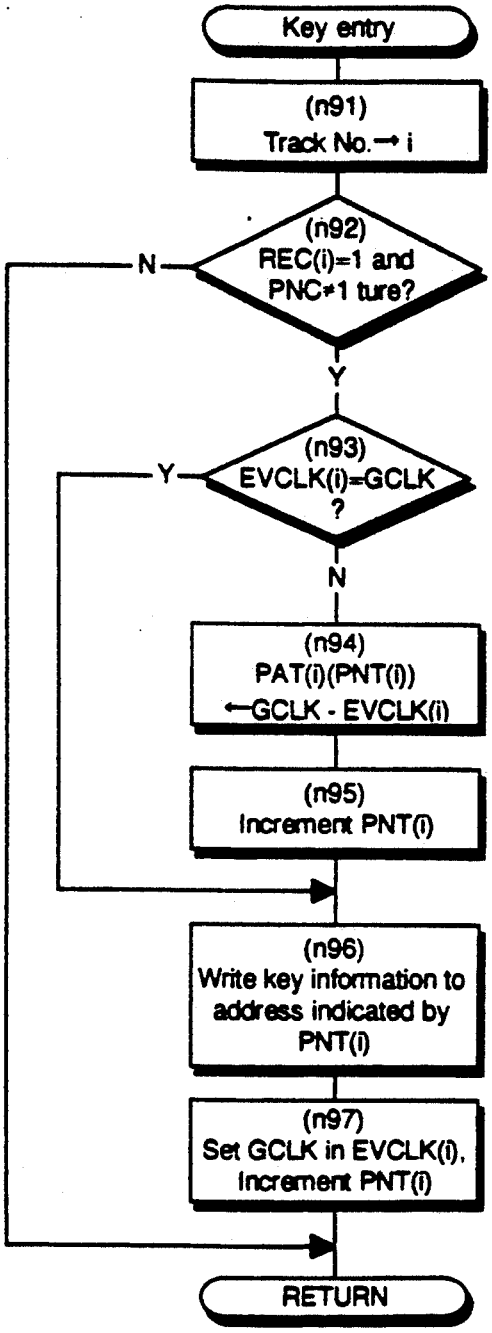

FIG. 16 illustrates the key entry subroutine. This subroutine is initiated when musical playing data is entered from keyboards or other musical playing instruments via the input/output circuit 8 in order to correct previously recorded musical playing data. Since musical playing data is entered in conformity with the MIDI format, track numbers (channel numbers) etc. are contained in the data. When the data is entered, first the track No. of the entered data is set in the track pointer i in n91. If writing is currently being performed on this track (REC=1 and PNC≠1), the operation starting with n93 is performed. If writing is not being performed, the process immediately returns to the main routine (n92). In n93, it is Judged whether EVCLK(i) is equal to the current GCLK. If they are equal, the entered key information is written in PAT(i)(PNT(i)) in n96, GCLK is set in EVCLK(i) (n96), PAT(i) is incremented (n97), and the process returns to the main routine. If EVCLK (i) is not equal to the current GCLK, GCLK minus EVCLK (i) is set in PAT (i) (PNT (i)) as the duration data between events (n94), and the pointer PNT(i) is incremented (n95), after which the process returns to the main routine.

Figure 17:
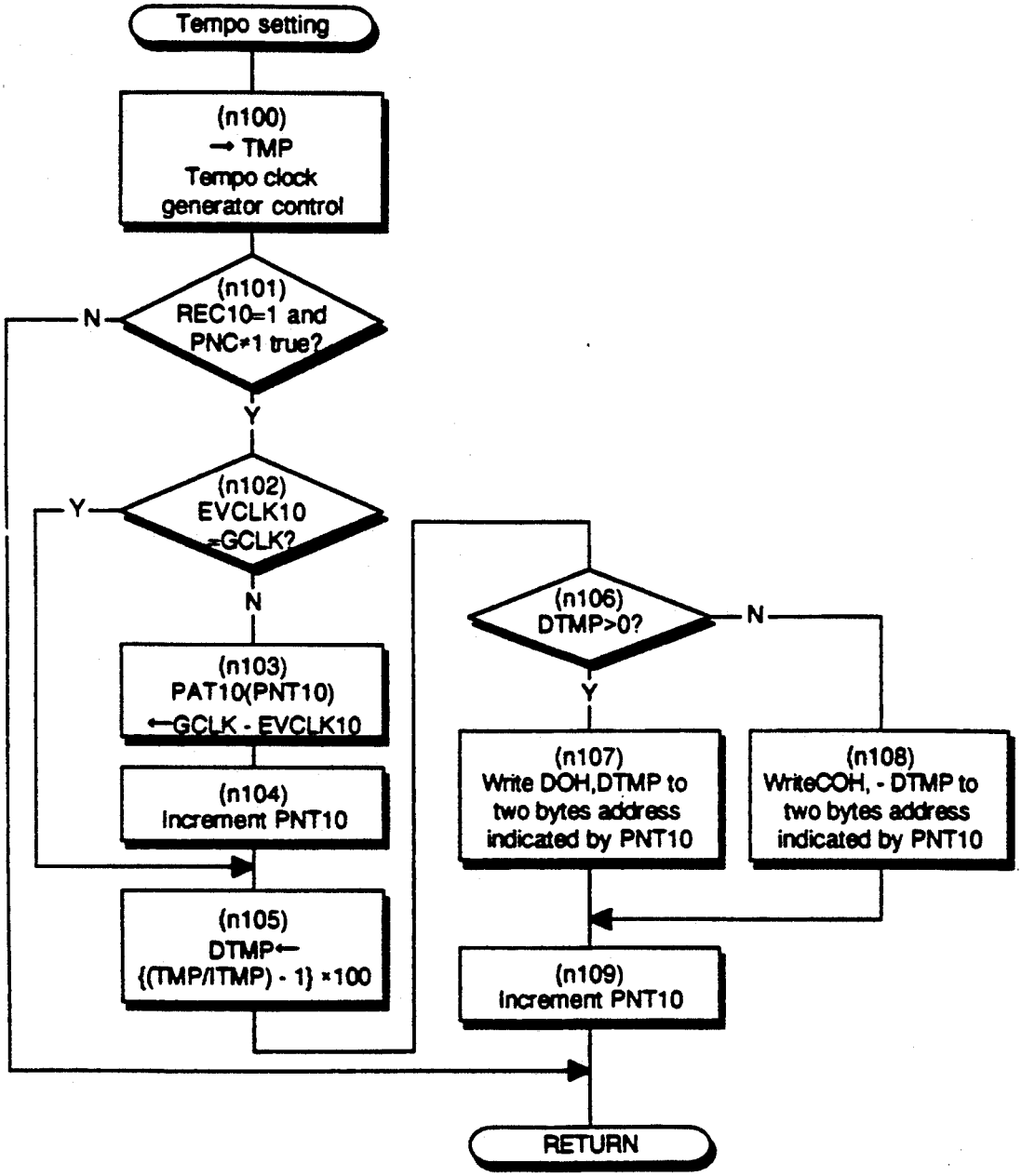

FIG. 17 illustrates the tempo setting subroutine. In this subroutine, in n100, the tempo clock Generator is controlled on the basis of the value of the TMP register. In this step, the rewriting of TMP is also performed using the tempo value entered from the tempo-up key 21, the tempo-down key 22 or the tempo switch 19 plus the numeric keys. If writing is currently being performed on the track (10) (REC (10) =1 and PNC≠1), the operation starting with n102 is performed after the above step. If writing is not being performed, the process immediately returns to the main routine (n101), In n102, it is judged whether EVCLK(10) is equal to GCLK, and if the values match, the tempo change rate is calculated with respect to the initial tempo value ITMP for the song data, and the result is stored in the DTMP register (n105). The tempo change rate is calculated as follows:

$$DTMP = \left\{ \frac{TMP}{ITMP} - 1 \right\} \times 100$$

When the value of DTMP is greater than 0, it means a tempo-up setting, and therefore, the tempo-up event data $DO_H$, DTMP (see FIG. 3 (E)) is written in PAT (10) (PNT (10)) (n107), after which the pointer PNT (10) is incremented (n109) and the process returns to the main routine. On the other hand, when the value of DTMP is negative, it means a tempo-down setting, and therefore, the tempo-down data $CO_H$, -DTMP is written in PAT(10)(PNT(10)), after which PNT(10) is incremented (n109) and the process returns to the main routine.

In n102, if EVCLK(10) and GCLK do not match, GCLK minus EVCLK is set in PAT(10) (PNT (10)) as the duration data (n103), the pointer PNT (10) is incremented (n104) and the process proceeds to n105.

Figure 18:
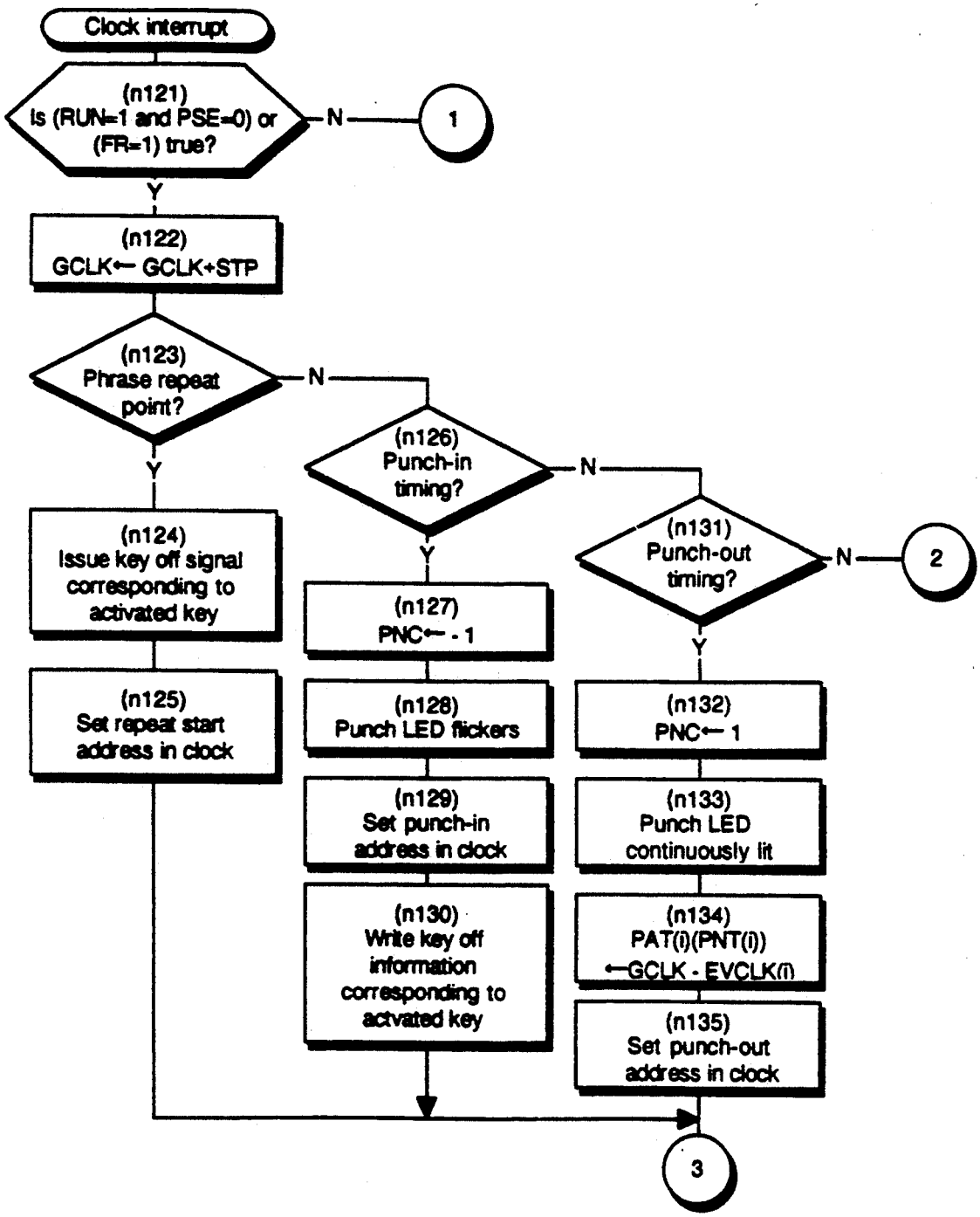
Figure 18:
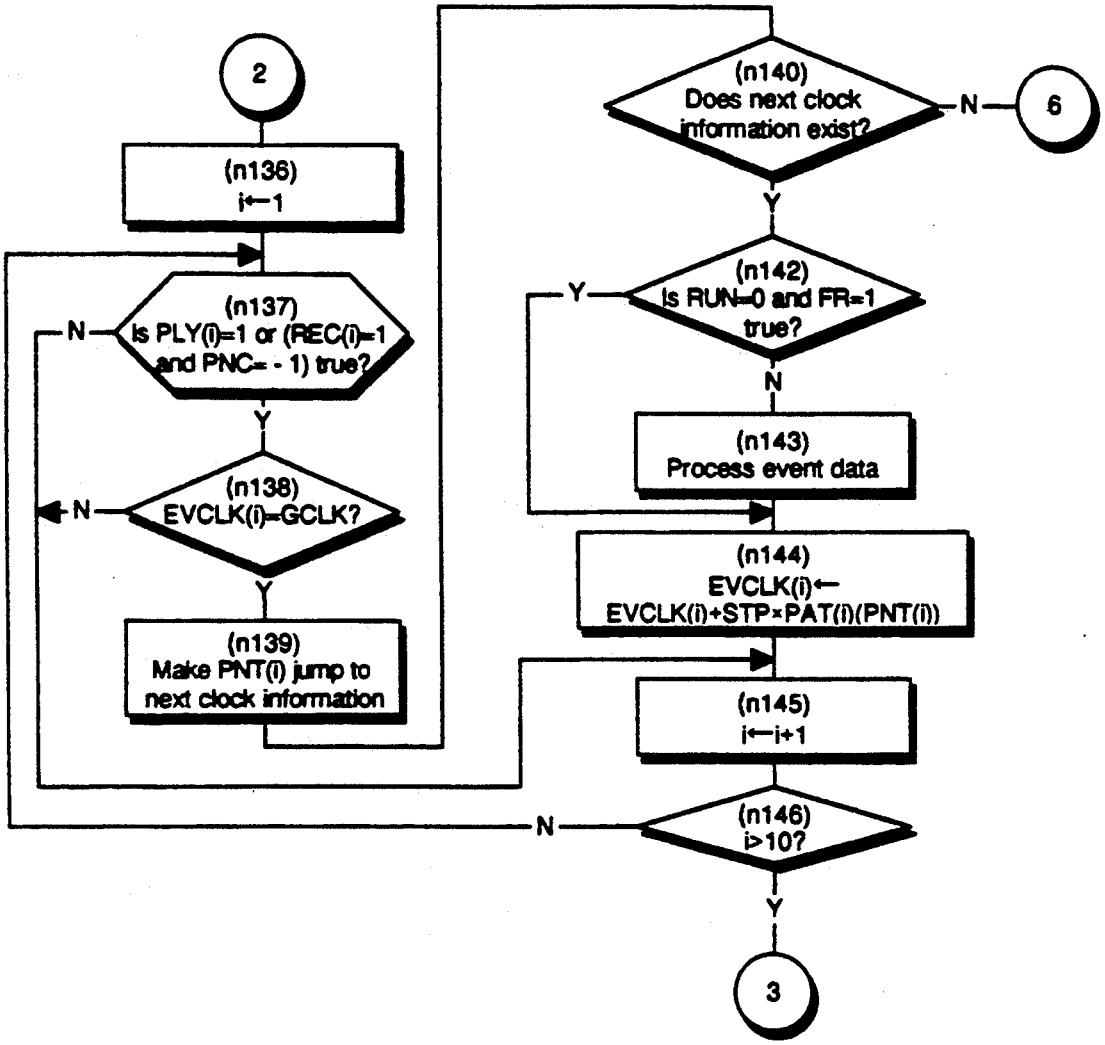
Figure 18:
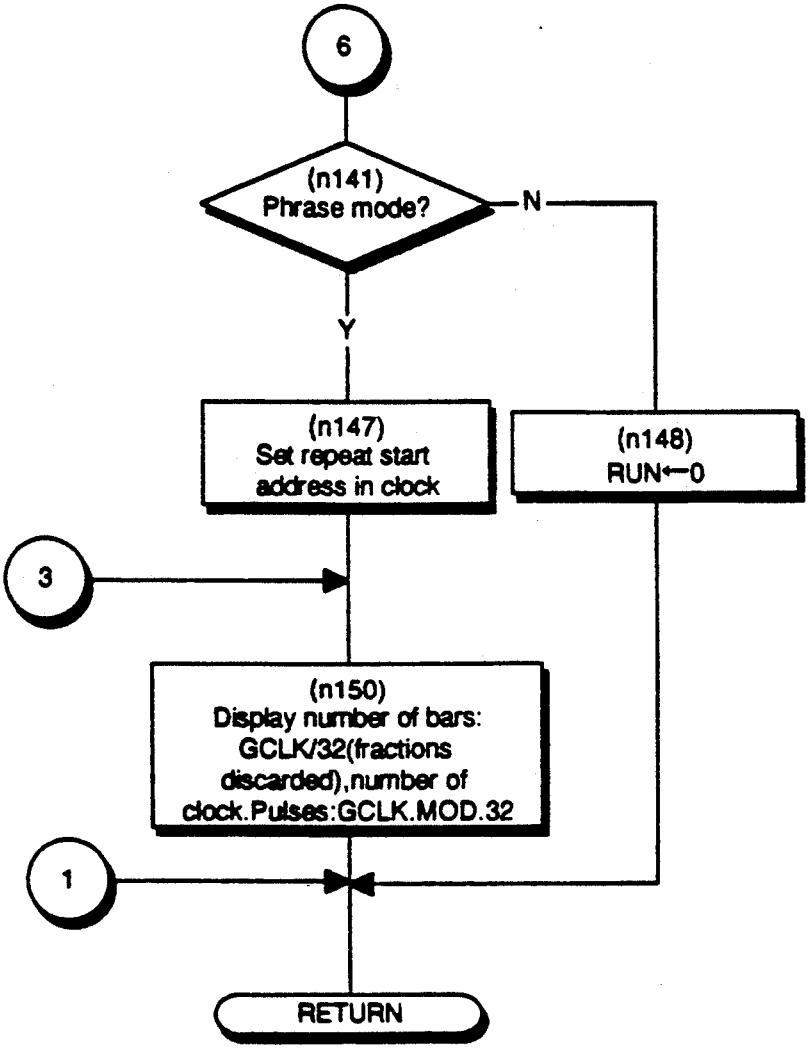

FIG. 18 illustrates the clock interrupt subroutine. This subroutine is initiated at every prescribed timing when interrupted by the tempo clock generator 6. In this operation, first it is judged whether reading/writing etc. is performed which is based on the clock signal, that is, whether (RUN=1 and PSE=0) or (FR=1) is true. If this condition is not met, the processing operation for the clock interrupt is not necessary, therefore, the process immediately returns to the main routine. If the condition is met, the operation starting with n122 is performed.

The operation starts by adding the value of STP to the general clock register GCLK to update the clock (n122). Since STP is +1 during normal reading/writing and during fast forward, GCLK is incremented by 1 at a time, and during rewind, since STP is −1, GCLK is decremented by 1 at a time. Thereafter, in n123, n126, and n131, it is judged whether it is a repeat point in the phrase mode, a punch-in timing, or a punch-out timing. In other cases, the process jumps to n136 and later steps to perform normal event clock increments and process event data.

When it is judged in n123 as a phrase repeat point, the operation starting with n124 is initiated. A phrase repeat point can be identified by the phrase mode flag PRS=1 and GCLK=:PRSEND (phrase end register). In n124, a key off signal corresponding to the activated key is issued to the sound source to turn off the musical sound currently generated, and PRSST is set: in GCLK to repeat from the start of the phrase while setting all ST:PNT (i) in PNT (i) and STCLK(i) in EVCLK(i) (n125), after which the process proceeds to n150.

When it is judged in n126 as a punch-in timing, the operation starting with n127 is performed. A punch-in timing can be identified by REC=1, PNC=1 and GCLK=PICLK for any given track. In n127, −1 which indicates punch-in recording is in progress is set in PNC, and the LED is put in a flickering condition (n128). Thereafter, PICLK minus TMPI(i) is set in EVCLK(i) for the track i for which REC(i)=1, while the top address of the punch-in section is set in PNT(i) (n129), after which the key off information corresponding to the currently activated key is written in PAT(i)(PNT(i)) indicated by the above PNT(i) (n130). The process then proceeds to n150.

On the other hand, when it is judged in n131 as a punch-out timing, the operation starting with n132 is performed. In n132, 1 is set in PNC. A punch-out timing can be identified by REC=1, PNC=−1 and GCLK=POCLK for any given track. Next, the LED is put in a continuously lit condition in n133, GCLK minus EVCLK(i) data is stored in PAT(i) (PNT(i)) indicated by PNT(i) in the track i that meets the above condition (n134), and GCLK plus TMPO(i) is written in EVCLK(i) while PNTPO (i) is written in PNT (i) (n135), after which the process proceeds to n150.

The operation starting with n136 is initiated to perform normal event clock increments and process event data for each track. First, in n136, 1 is set in the track pointer i, and then, in n137 and n138, it is judged with respect to this track whether reading of musical playing data is being performed (PLAY(i)=1), punch-in recording is being performed (REC(i)=1 and PNC=−1), or EVCLK(i)=GCLK is true. If any of these conditions is met, the operation starting with n139 is performed. If none of these conditions is met, since it is not necessary to go through the subsequent steps, the process jumps to n145 where 1 is added to i, and the operation starting with n137 is repeated till i exceeds 10 (n146).

In n139, the pointer PNT(i) is made to jump, with STP as the reference, to the next clock information (duration data) in the forward direction of the clock (n139). As a result of this jumping action, if the next clock information does not exist, it is udged that the music is at its end, and the process proceeds from n140 to n141. If the next clock information exists, the current event information (key on, key off, etc.) is processed (n143) except in the case of fast forward and rewind (n142). The event information is processed exactly as indicated by its contents in the case of forward playback (STP=1), while in the case of reverse playback (STP=−1) reverse processing is performed. The reverse processing means, for example, key off processing in the case of a key on event, tempo-down processing in the case of a tempo-up event, etc. Next, in n144, STP is multiplied by the clock information PAT(i) (PNT(i)), the result being added to EVCLK(i). This means that PAT(i)(PNT(i)) is decremented in the case of rewind. After that, the process proceeds to n145.

After proceeding to n141 because of absence of the next clock information, the process further proceeds from n141 to n147 in the case of the phrase mode, where PRSST is set in GCLK to repeat from the start of the phrase, while setting STPNT(i) in all PNT(i) and STCLK(i) in EVCLK(i), before proceeding to n150. In other cases, the RUN flag is reset to end the playing (n148), and the process returns to the main routine.

In n150, the number of bars currently being written or read and the number of clock pulses are displayed on the display. The number of bars to be displayed is calculated by GCLK/32, while the number of clock pulses is calculated by GCLK.MOD.32. After displaying the numbers, the process returns to the main routine.

What is claimed is:

1. A musical playing data processor comprising:

time specifying means for specifying a first time indicative of a start of a predetermined musical playing period and a second time indicative of an end of the predetermined musical playing period in real time while previously recorded musical playing data is being reproduced, the first and second times being specified in accordance with a number of clock pulses;

first time storage means for storing the specified first time;

second time storage means for storing the specified second time;

record means for recording in real time new musical playing data, wherein the previously recorded musical playing data between the first and second specified times is replaced with the new musical playing data.

2. A musical playing data processor according to claim 1, wherein said timing specifying means includes a switch.

3. A musical playing data processor according to claim 2, wherein said timing specifying means alternately specifies the first time and the second time when the switch is operated.

4. A musical playing data processor according to claim 1, wherein said previously recorded musical playing data is recorded on multiple tracks and said recording means records the new musical playing data on at least one of the multiple tracks.

5. A musical playing data processor comprising:

timing specifying means for specifying phrase timing data while previously recorded musical playing data is reproduced, the phrase timing data being specified in accordance with a number of clock pulses representing positions of the musical playing data;

phrase timing storage means for storing the phrase timing data;

phrase timing select means for selecting phrase timing data stored in the phrase timing storage means; and phrase reproducing means for repeatedly reading out and reproducing the previously recorded musical playing data in a period corresponding to the selected phrase timing data.

6. A musical playing data processor according to claim 5, wherein said timing specifying means is a switch.

7. A musical playing data processor according to claim 5, wherein said phrase timing select means includes a switch and a plurality of numeric keys.

8. A musical playing data processor according to claim 7, wherein said timing specifying means specifies the phrase timing data while the previously recorded musical playing data is reproduced and said phrase time storage means includes sorting means for sorting the specified phrase timing data.

9. A musical playing data processor according to claim 7, wherein said previously recorded musical playing data is recorded on a plurality of tracks simultaneously and said phrase reproducing means is capable of reproducing a phrase recorded on at least one track of the plurality of tracks.

10. A musical playing data processor comprising:

musical playing data record means for recording musical playing data including tempo data, the tempo data including an initial tempo value;

musical playing data read out means for reading out the recorded musical playing data at a rate based on the tempo data;

record means for recording new tempo data, the new tempo data being recorded as a rate of change from the initial tempo value.

11. A musical playing data processor according to claim 10, wherein said musical playing data is recorded on a plurality of tracks, wherein at least one of the plurality of tracks is used for said tempo data.

12. A playing musical data processor according to claim 10, wherein said initial tempo value is recorded at a start position of the musical playing data.

13. A playing musical data processor according to claim 10, further comprising calculating means for calculating said rate of change from the initial tempo value and the new tempo data.

14. A musical data processor according to claim 5, wherein the phrase timing data includes user selectable beginning and ending points, the phrase reproducing means repeatedly reading out and reproducing the previously recorded musical playing data in a period corresponding to a user selected beginning point and end point.

15. A musical playing data processor comprising:

first storage means for storing a first time value, second storage means for storing a second time value, specifying means for specifying, in real time while previously recorded musical playing data is being reproduced, a predetermined musical playing period based on the first time value and the second time value, recording means for recording in real time new musical playing data, wherein the previously recorded musical playing data in the predetermined musical playing period is replaced with the new musical playing data.

* * * * *